United States Patent [19]

Schuierer

[11] 4,269,047

[45] May 26, 1981

[54] APPARATUS FOR PASSING A WORKING MEDIUM THROUGH A CONTINUOUSLY MOVING PERMEABLE FABRIC WEB

[75] Inventor: Manfred Schuierer, Michelstadt, Fed. Rep. of Germany

[73] Assignee: Bruckner Apparatebau, Erbach, Fed. Rep. of Germany

[21] Appl. No.: 40,063

[22] Filed: May 17, 1979

[30] Foreign Application Priority Data

May 22, 1978 [DE] Fed. Rep. of Germany ..... 2822214

[51] Int. Cl.[3] ..... D06B 5/08

[52] U.S. Cl. ..... 68/181 R; 15/306 A; 68/20; 68/158

[58] Field of Search ..... 68/20, 158, 175, 181 R; 134/64 R, 64 P, 122 R, 122 P; 15/306 A, 307; 34/160; 118/50

[56] References Cited

U.S. PATENT DOCUMENTS

| | | | |
|---|---|---|---|
| 883,536 | 3/1908 | Gessner | 15/306 A X |
| 1,789,132 | 1/1931 | Birch | 15/307 |
| 2,142,711 | 1/1939 | Birch | 15/306 A |
| 4,045,598 | 8/1977 | Henson | 118/50 X |
| 4,166,368 | 9/1979 | Beninca et al. | 15/306 A X |
| 4,225,991 | 10/1980 | Bolton et al. | 15/306 A X |

*Primary Examiner*—Philip R. Coe
*Attorney, Agent, or Firm*—Marshall & Yeasting

[57] ABSTRACT

A tube has a longitudinal slot extending over the entire working width of the apparatus, and at least one cover element is arranged on the side of the fabric web remote from the slotted tube. The cover element extends over the entire length of the slot, and also extends over a substantial portion of the path of the fabric web, immediately preceding the slot, and over another substantial portion of the path of the fabric web immediately following the slot. A guide surface for the fabric web is provided on the same side of the web as the slotted tube, which surface forms with the cover element a flow space for conducting the working fluid, which flow space extends from a point in the path of travel of the fabric web lying substantially ahead of the slot to a point in the path of the web lying substantially beyond the slot.

9 Claims, 5 Drawing Figures

APPARATUS FOR PASSING A WORKING MEDIUM THROUGH A CONTINUOUSLY MOVING PERMEABLE FABRIC WEB

BACKGROUND OF THE INVENTION

This invention relates to an apparatus for passing a working medium through a continuously moving permeable fabric web, comprising a slot nozzle extending over the entire working width of the apparatus and at least one cover element arranged on that side of the fabric web remote from the slot nozzle.

It frequently happens, particularly in the treatment of textile webs, that a working medium has to be passed through the textile web under pressure or suction. A typical example of this is the removal of water from wet-treated textile webs where the textile web is transported for example over the narrow opening of a slot nozzle which is connected to a suction fan so that liquid is withdrawn from the textile web as it passes over the slot nozzle opening. It is also possible to pass a working medium for example through a permeable plastics web.

In addition, it is known that either a gaseous medium (for example air) or a liquid medium (for example water or the like) can be passed through a web of this type.

Since an apparatus of the type in question and the slot nozzle which it contains are generally designed for fabric webs of different widths, it frequently happens that the width of the fabric web being treated is narrower than the working width of the apparatus and the effective width of the slot nozzle. For this reason, it is necessary to associate with the slot nozzle a cover element by which those parts of the slot nozzle opening which remain exposed adjacent the edges of the fabric web can be covered so that no extraneous air is led past the edges of the fabric web to be treated.

Various types of cover elements for the slot nozzle opening are known in practice. In one known embodiment, the cover element consists essentially of a kind of rubber lip which is applied to the exposed part of the slot nozzle opening. In another known embodiment, the cover element consists of a flexible tube which is held over the central portion of the working width of the slot nozzle in such a way that it hangs down at both ends. In the case of a suction-type slot nozzle, the reduced pressure sucks the flexible tube into the side regions of the slot nozzle opening which are not covered by the fabric web to be treated, so that the full reduced pressure is always automatically directed onto the fabric web.

With all these known embodiments, it has been found that the working medium is generally not passed through with sufficient intensity. In other words, the fabric web to be treated is not adequately permeated by the working medium.

SUMMARY OF THE INVENTION

Accordingly, the object of the present invention is to improve an apparatus of this type in such a way that, above all, the intensity with which the working medium is passed through a fabric web to be treated is considerably increased as compared with the known embodiments.

According to the invention, this object is achieved in that the cover element not only extends over the entire width of the slot nozzle and over portions of the fabric web preceding and following the slot nozzle opening but also forms, together with guide surfaces arranged along both sides of the slot nozzle, a flow space in which the working medium flows to the slot nozzle substantially longitudinally of the fabric web, from both sides of the slot nozzle.

The invention is based on the knowledge that, in all the known embodiments mentioned above, the working medium is guided through the fabric web to be treated in a direction substantially perpendicular to the surface of the web, i.e. over the shortest path through the web. In contrast, the embodiment according to the invention guides the working medium through the fabric web to be treated over a longer path, so that the fabric web is more intensively permeated by the working medium.

The cover element designed and arranged according to the invention and the cooperating guide surfaces create the above-mentioned flow space for the working medium, through which the fabric web to be treated is transported, the distance between the cover element and the guide surfaces (i.e. the height of the flow space) obviously corresponding substantially to the thickness of the fabric web to be treated. Since both the cover element and the guide surfaces are impermeable, the working medium to be guided through the fabric web (looking in the direction of travel of the fabric web) has to flow to the slot nozzle opening in the direction of travel of the fabric web in the region preceding the slot nozzle opening, and in the opposite direction in the region following the slot nozzle opening. In this way, a relatively long flow path through the fabric web is obtained, with the result that the fabric web is permeated extremely intensively by the working medium.

The above-described mode of operation of the apparatus according to the invention has proved to be so effective, for example in the removal of water from textile webs, that, for the same suction power generated by a suction fan, the residual moisture content of the web is for example only half as great (and in some cases less) than in a conventional liquid extraction system.

However, the apparatus according to the invention may be used not only for passing air through a web under suction or pressure, but equally effectively for washing a liquid out of a web by passing a second liquid through the web. In addition, it is possible intensively to impregnate a dry fabric web, particularly a textile web, with a liquid over a relatively short path.

In the apparatus according the invention, it is best that the guide surfaces be adapted to the guide path of the fabric web. This means that, where the fabric web is guided over the slot nozzle opening in a plane, the guide surfaces are correspondingly flat, whereas in cases where the fabric web is guided over the slot nozzle along a curved path the guide surfaces are correspondingly curved.

In another embodiment of the invention, the cover element may be in the form of a flexible cover strip which, looking in the direction of travel of the fabric web, is fixedly held only at its rear edge and, up to this fixing zone, lies loosely on the fabric web and on the exposed parts of the slot nozzle opening. In this way, the distance between the cover element and the guide surfaces (and hence the internal height of the flow space) can always be automatically adapted to the particular fabric web to be treated.

In the treatment of sensitive fabric webs, it might happen that the fabric web to be treated is sucked tight over the relatively long path through the flow space, giving rise to certain tensions. In another embodiment of the invention, this is avoided by using a cover element in the form of an endless, impermeable belt which is guided over guide rollers, and of which one flight covers the fabric web on its side opposite the slot nozzle opening, in the region over the guide surfaces. This embodiment prevents any interference with the movement of the fabric web, i.e. the use of the belt prevents tension from building up to any significant extent in the fabric web, which is particularly important in the case of fabrics sensitive to stretching.

It can also be of advantage, particularly in the latter embodiment, for that side of the guide surfaces which is in contact with the fabric web to be made of a particularly low-friction material.

DESCRIPTION OF THE PREFERRED EMBODIMENTS

In all the embodiments described, the apparatus is primarily intended for guiding a working medium under suction through a continuously moving textile web, air generally being used as the working medium. It is also pointed out that the drawings only show those parts of the apparatus according to the invention which are regarded as essential to its description.

Figure 1:
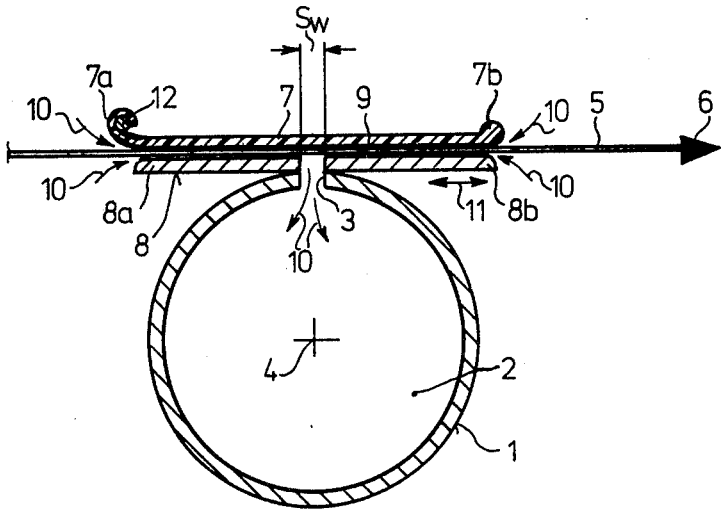
FIG. 1 is a diagrammatic cross-section through a first embodiment of the invention in which the fabric web follows a flat guide path in the region of the slot nozzle.

In the first embodiment, illustrated in FIG. 1, a slot nozzle is provided by a tube 1 of circular cross section, which extends over the entire working width of the apparatus, perpendicularly to the plane of the drawing. The interior 2 of this tube 1 is connected in the usual way to the suction side of a fan (not shown) so that the slot nozzle thus acts as a suction nozzle. In its upper region, the tube 1 comprises over its entire length (working width) a narrow slot nozzle opening 3 which runs parallel to the longitudinal axis 4 of the tube.

This first embodiment is intended for treating a permeable textile web 5 which, in the region of the slot nozzle, is guided along a flat (in this case substantially horizontal) path and is continuously transported in the direction of the arrow 6 by means not shown.

A cover element 7 is arranged on that side of the textile web 5 remote from the slot nozzle, extending over the entire width of the slot nozzle and, as shown particularly clearly in FIG. 1, over a region lying ahead of and following the slot nozzle 1. A guide surface 8 is arranged on the same side of the textile web as the slot nozzle and also extends over the entire working width of the slot nozzle. In this case, the guide surface 8 is formed by two flat guide plates 8*a*, 8*b*, one of which (8*a*) is arranged ahead of and the other (8*b*) following the slot nozzle opening 3, so that the slot nozzle opening 3 is not obstructed by the guide plates 8*a*, 8*b*.

The cover element 7 and the guide surface 8 together form a flow space 9 for the working medium, which flows to the slot nozzle substantially longitudinally of the textile web 5 in both directions (as indicated by the arrows 10). The clearance between the cover element 7 and the guide surface 8 is governed by the thickness of the textile web 5 to be treated and is normally substantially equivalent to the thickness of this textile web, so that a large part of the working medium (in this case air, arrows 10) to be sucked through the textile web 5 from the nozzle has to flow through the textile web 5 substantially in its longitudinal direction. In this way, liquid for example contained in the textile web 5 is extracted from this textile web during its very intensive permeation by the working medium. In the case of FIG. 1, therefore, most of the working medium is sucked substantially horizontally through the textile web 5 in the flow space 9. To ensure that the working medium can always be sucked through the fabric web in this way, the two sections of the flow space 9 lying ahead of and behind the slot nozzle opening 3 in the direction of travel (arrow 6) of the fabric web should each be at least three times as long as the slot nozzle opening 3 is wide (slot width Sw). In the embodiment illustrated in FIG. 1, the flow passage sections lying ahead of and behind the slot nozzle opening each have a length approximately seven times as great as the width Sw of the slot nozzle opening 3. Depending on the nature of the fabric web and on the type and intensity of the proposed treatment, the length of the flow passage sections lying ahead of and behind the slot nozzle opening may with advantage be up to twenty times as great as the width of the slot nozzle opening.

FIG. 1 also shows that the guide surface 8 (i.e. the two guide plates 8*a* and 8*b*) is adapted to the guide path of the textile web 5, i.e. the two guide plates are directed substantially horizontally. With this design and arrangement of the two guide plates 8*a* and 8*b*, it is also possible for at least one of these two guide plates, in this case the guide plate 8*b* for example, to be displacable in the longitudinal direction of the textile web 5, as indicated by the double arrow 11. In this way, the effective width of the slot nozzle opening can be adjusted.

In this first embodiment, the cover element is in the form of a flexible cover strip 7 which is preferably made of rubber or of a rubber-like plastics material. As seen in the direction of travel (arrow 6) of the fabric web, this cover strip 7 is fixedly held at its rear edge 7*a*, for example by means of a rod 12 extending substantially parallel to the slot nozzle at a short distance above the textile web 5. Except at this fixing zone (7*a*), the cover strip 7 lies loosely on the textile web 5 and on the exposed parts of the slot nozzle opening 3 (on both sides of the longitudinal edges of the textile web). Accordingly, this impermeable cover strip 7 automatically adapts itself to the thickness of the particular textile web being treated. To enable the working medium also to flow favourably into the flow space 9 in the region of the front edge 7*b*, opposite the fixing zone 7*a*, this front edge 7*b* is preferably in the form of a bead.

The guide surface 8 shown in FIG. 1 could of course also be formed by a single guide plate which, in this case, would have to be provided with a slot opening corresponding to the slot nozzle opening 3, in which case the two openings would have to be positioned exactly one above the other.

Figure 2:
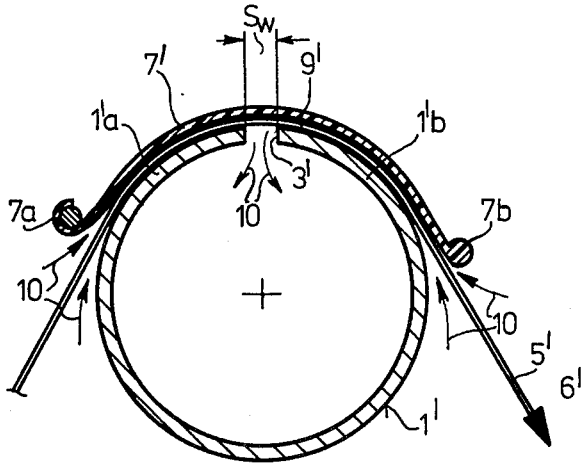
FIG. 2 is a cross-section through a second embodiment in which the fabric web follows a curved guide path over the slot nozzle.

FIG. 2 shows a modification of the embodiment illustrated in FIG. 1. In this second embodiment of the invention, the slot nozzle and the cover element 7' may have substantially the same configuration as in the first embodiment, which explains why the same reference numerals accompanied by an apostrophe have been used, so that their respective constructions may be deduced by referring to the above example.

The main difference between the embodiment illustrated in FIG. 2 and the embodiment illustrated in FIG. 1 resides in the fact that, in the region of the slot nozzle, the textile web 5' to be treated is guided along a curved path in the direction of the arrow 6'. In other words, in the region ahead of and behind the slot nozzle opening 3', the textile web 5' is slidingly guided over the outer periphery of the tube 1'. In this case, the sections 1'*a* and 1'*b* of the tube 1, situated ahead of and behind the slot nozzle opening 3', simultaneously form the guide surface.

In this embodiment (FIG. 2), too, the rear edge 7*a*' of the cover strip 7', looking in the direction of travel (arrow 6') of the textile web 5', is fixedly held at a short distance above the textile web 5', whereas the rest of the cover strip 7' adapts itself to the curvature of the textile web 5' and the slotted tube 1'. In this way, there is again formed a flow space 9' which, in this case, is correspondingly curved, but also ensures extremely reliably that the working medium (arrows 10) is sucked through the textile web 5' over a relatively long path (substantially corresponding to its guide path).

The embodiments of the invention described above with reference to FIGS. 1 and 2 are mainly suitable for fabric webs which are not sensitive to tension (for example velvet carpets, permeable plastics webs and the like). If, on the other hand, it is desired to treat textile webs that are sensitive to tension or stretching, with the apparatus according to the invention, it is advisable to take measures for moving the textile webs past the slot nozzle completely free from tension. Embodiments which accomplish this are described below, with reference to FIGS. 3 to 5.

Figure 3:
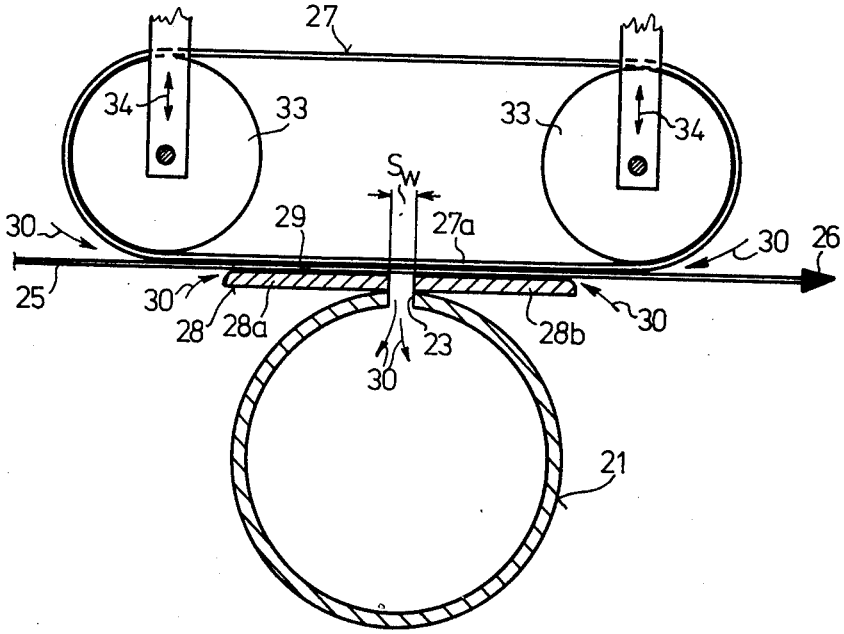
FIG. 3 is a cross-section through a third embodiment in which the fabric web follows a flat guide path and a belt is used as the cover element.

In the embodiment illustrated in FIG. 3, the slotted tube 21 is largely designed and arranged in the same way as in the embodiment illustrated in FIG. 1. The same also applies to the design and arrangement of the guide surface 28, which is formed by two substantially flat guide plates 28*a* and 28*b* arranged ahead of and behind the slot nozzle opening 23. The textile web 25 to be treated, which is continuously moved in the direction of the arrow 26, is again guided along a substantially flat (in this case again horizontal) path in the region of the slotted tube 21.

However, the cover element of this embodiment is in the form of an endless, impermeable belt 27 which is guided over guide rollers 33, and which is driven in such a way (by a drive not shown) that its lower flight 27*a* which is in contact with the textile web 25 has the same direction of movement as the textile web 25. This lower flight 27*a* of the belt 27 covers the upper side of the fabric web 25 in the region above the guide surface 28. Accordingly, a flow space 29 is again formed between the lower flight 27*a* and the guide surface 28, in such a way that a large part of the working medium (arrows 30) is sucked through the textile web 25 in the longitudinal direction thereof.

In order in this case also to enable the clearance between the lower flight 27*a* covering the fabric web and the guide surface 28 to be adapted as required to the thickness of the textile web 25, adjustment means (not shown) are best provided by which the belt or rather its supporting frame can be adjusted substantially vertically in the direction of the double arrows 34.

Figure 4:
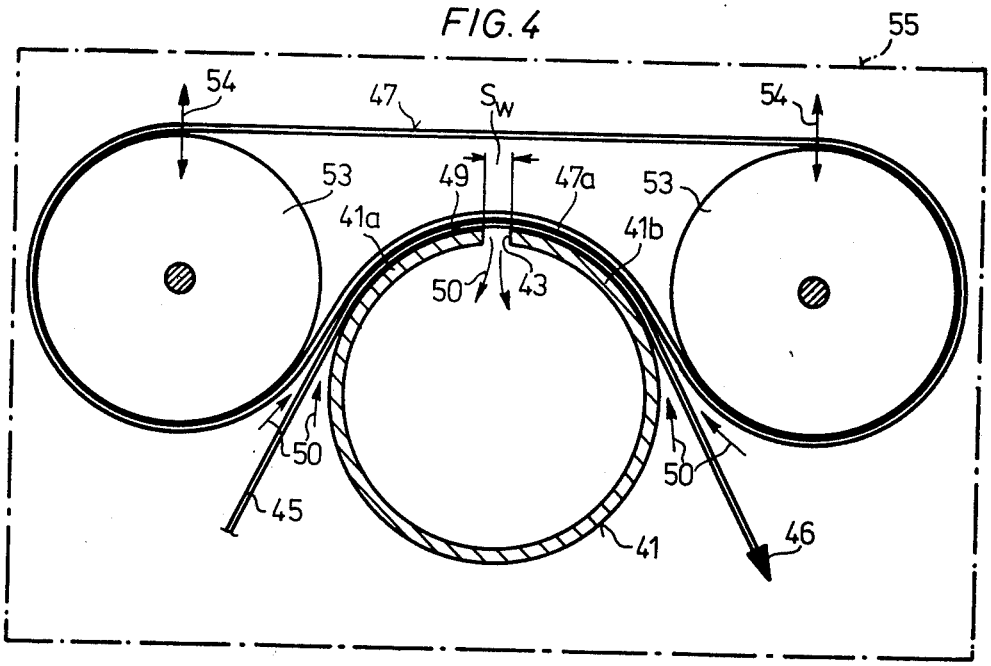
FIG. 4 is a cross-section through a modification of the apparatus illustrated in FIG. 3 in which the fabric web follows a curved guide path.

FIG. 4 shows an embodiment somewhat modified in comparison with the embodiment illustrated in FIG. 3. In this case, the textile web 45 to be treated is guided along a curved path in the region of the slotted tube 41 (the direction of travel of the fabric web being indicated by the arrow 46), as in the embodiment shown in FIG. 2.

The design and arrangement of the slotted tube 41 corresponds exactly to the embodiment shown in FIG. 2. In other words, the sections 41*a* and 41*b* of the slotted tube 41, which are situated ahead of and behind the slot nozzle opening 43, simultaneously form the guide surface for the textile web 45.

As in the embodiment illustrated in FIG. 3, the cover element arranged on that side of the textile web 45 remote from the slotted tube 41 is formed by an endless, impermeable belt 47 which in this case is guided around two guide rollers 53 and, with its lower flight 47*a* in contact with the fabric web, circulates in the same direction in which the textile web 45 is moved (arrow 46). Once again, the lower flight 47*a* of the belt 47, together with the guide surfaces (41*a*, 41*b*), forms the flow space 49 for the working medium flowing to the slotted tube 41 substantially longitudinally of the textile web 45 in both directions (arrows 50).

In this case, too, the belt 47 is adjustable in its position relative to the slotted tube 41, in the direction of the double arrows 54 (i.e. in the vertical direction). The advantage of this adjustability is that, on the one hand, it enables the relative position to be adjusted for changing the internal height of the flow space 49, or for changing the particular length of the flow space sections lying ahead of and behind the slot nozzle opening 43 (commensurately with the slot width of the slot nozzle opening), whilst on the other hand it is possible to raise the conveyor belt from the slotted tube to allow access to the tube, for example for maintenance purposes.

Both in the case of FIG. 3 and in the case of FIG. 4, a fabric web sensitive to stretching is effectively supported, so that such a fabric web is able to pass the slot substantially free from tension and, nevertheless, can be permeated extremely intensively by the working medium. Compared with known apparatus comprising rotating suction drums over whose perforated surfaces fabric webs sensitive to stretching are guided, this embodiment of the invention, in addition to being structurally more simple, affords the further major advantage that the treated fabric web is not left with any impressions from the perforated drum.

In the embodiments illustrated in FIGS. 1 to 4, the working medium (particularly air) is sucked through the moving fabric web. In other words, the nozzle is in the form of a suction nozzle and is preferably connected to the suction side of a fan.

However, it is equally impossible in some types of treatment for the nozzle to be in the form of a pressure nozzle connected to the pressure side of a fan. In this case, the slotted tube (and with it the cover element and the guide surface) is preferably arranged in a pressure-tight treatment chamber. An arrangement such as this is diagrammatically illustrated for example in FIG. 4. In other words, if the slotted tube 41 is in the form of a pressure nozzle, it is accommodated together with its endlessly circulating cover element 47 in a pressure-tight treatment chamber (indicated in dash-dot lines at 55).

With the various embodiments of the invention described above, not only is it possible to pass a gaseous working medium (particularly air) through the fabric web under pressure or suction, for example for the purpose of removing water, but also it has proved to be of advantage in many cases to operate the apparatus with a liquid working medium if, for example, a first fluid which the fabric web already contains from a previous treatment is to be washed from the web by means of a second liquid. In this case, the slotted tube may be connected to the suction or pressure side of a pump, depending on whether the nozzle is in the form of a suction nozzle or a pressure nozzle.

Another possible embodiment of the apparatus according to the invention is described with reference to FIG. 5. In this case, in contrast to the embodiments shown in FIGS. 1 to 4, the slotted tube 61 is arranged with its slot nozzle opening 62 facing downwards. A cover element in the form of an endless circulating belt 63 is associated with the slotted tube 61 from below, being guided around two guide rollers 64 and circulating with its upper flight 63*a* in contact with the fabric web 65, in the same direction as the fabric web 65. The embodiment described thus far is substantially the same as the embodiment illustrated in FIG. 4, apart from the inverted arrangement and design, so that as far as the remaining structural arrangement of these parts is concerned reference is made to the corresponding parts of FIG. 4. Another significant difference between the embodiment illustrated in FIG. 4 and the embodiment illustrated in FIG. 5 resides in the fact that the slotted tube 61 (which at its outer sides ahead of and behind the slot nozzle opening 62 simultaneously forms a guide surface for the fabric web 65) is immersed with the cover element 63 in a liquid bath 66 (for example a dye solution) accommodated in a container 67. In this embodiment, it is important to ensure that at least the nozzle opening 62 and the flow space formed ahead of and behind it, between the corresponding outer sides of the tube 61 and the upper flight 63*a* of the cover element, are immersed in the liquid bath 66.

Figure 5:
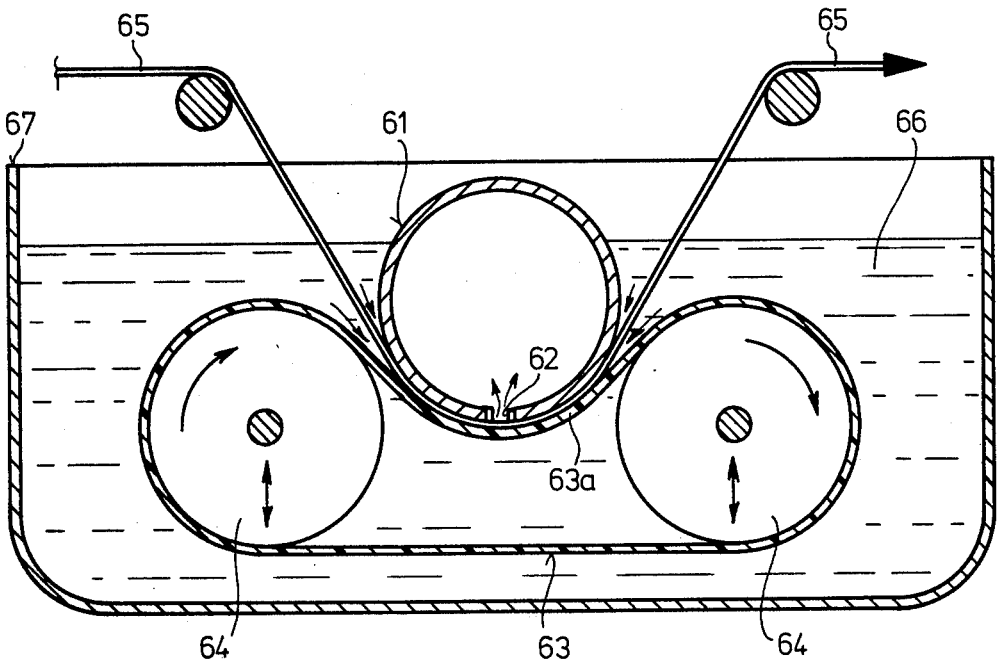
FIG. 5 is a cross-section through an apparatus similar to that shown in FIG. 4 in which the slot nozzle works in a liquid bath.

With the embodiment illustrated in FIG. 5, it is possible to obtain an extremely intensive treatment of a continuously moving fabric web with liquid over a relatively short treatment time, the liquid preferably being sucked through the fabric web (largely in its longitudinal direction) by means of the slotted tube 61.

The apparatus according to the invention may also be used with equal advantage in cases where a dry fabric web (particularly a dry textile web) is to be impregnated intensively with a liquid over a very short path, as is the case for example in the treatment of a textile web in a dyeing pad where the fabric web is correspondingly impregnated before dyeing.

So far as the arrangement and design of the apparatus are concerned, it is further pointed out that the slotted tube does not necessarily have to be arranged horizontally, as in the embodiments described above, but may also be obliquely or vertically arranged, in which case the fabric web is moved past the tube obliquely or vertically. It is also pointed out that the guide surface may consist of a plastics material having a favourable coefficient of friction or may be coated with such a plastics material.

The extremely effective way in which the apparatus according to the invention works is further illustrated by the following Examples.

EXAMPLE 1

A polyamide velvet carpet was treated in the apparatus shown in FIG. 1. The velvet carpet had a nonwoven backing and contained 900 g of pile material, the pile depth amounting to 8 mm. Before introduction into the apparatus, the velvet carpet was dripping wet and contained about 600 to 700% of water. The carpet was continuously transported through the apparatus at a treatment speed of 10 m/minute. In the apparatus, water was extracted from the carpet by means of the slotted tube. After passing through the apparatus, the carpet had a residual moisture content of 35%.

A comparison test with the same fabric web having the same water content was carried out at the same treatment speed using a conventional apparatus of the type initially described (with substantially vertical penetration of the air through the fabric web). After passing through this known apparatus, the carpet had a residual moisture content of as much as 75%.

EXAMPLE 2

A knitted fabric of texturized polyester (300 g/m: 1.5 meters wide), sensitive to stretching, was treated in the apparatus illustrated in FIG. 4. On entering the apparatus, this knitted fabric contained approximately 200% of liquid. After passing through the apparatus illustrated in FIG. 4, the knitted fabric had a residual liquid content of 25%.

Under the same conditions, the same knitted fabric was treated on a conventional suction drum with a perforated surface. After passing through this known apparatus, the knitted fabric had a residual liquid content of 80%.

EXAMPLE 3

A hydrophobic fabric of polyester and cotton was treated with a dye solution in the apparatus illustrated in FIG. 5. The fabric web was transported through the apparatus at a rate of 50 m/minute. Despite the relatively short contact time (less than one second) between the dye solution and the fabric, the fabric was impregnated extremely uniformly.

A comparison test in which the fabric was passed through the dye solution equally quickly, but without any additional measures, resulted in extremely poor penetration of the dye.

EXAMPLE 4

A fabric of pure cotton was impregnated with a synthetic resin solution. The cotton fabric was then passed through an apparatus according to the invention which was designed for the extraction of the treatment liquid (constructed according to FIG. 4). After the treatment, the fabric had a residual solution content of approximately 30%.

In order to be able to achieve as sparing an application of liquid as this, it has hitherto been necessary to apply the liquid by spray coating or splash coating, both of which involve difficulties in regard to controlling the wetting of the fabric web. However, where the treatment is carried out with the apparatus according to the invention, the fabric is thoroughly wetted and the amount of solution remaining in the fabric can be controlled relatively accurately.

EXAMPLE 5

An apparatus of the type illustrated in FIG. 4 was arranged between two washing baths. This arrangement was used for washing previously dyed or printed cotton material. By virtue of the apparatus according to the invention, arranged between the washing baths, it was possible to extract so much liquid that the two washing baths could be very effectively separated, resulting in extremely efficient washing.

EXAMPLE 6

A knitted fabric of predominantly synthetic fibres was treated in the apparatus illustrated in FIG. 5. The knitted fabric had been printed and subsequently impregnated with water. The working medium used in the apparatus was a bath of perchloroethylene. The water contained in the knitted fabric together with the dirt particles present therein were largely removed by means of this working medium. The fabric left the apparatus with a water content of less than 5%.

I claim:

1. Apparatus for passing a working fluid through a continuously moving permeable fabric web, comprising a tube having a longitudinal slot which extends over the entire working width of the apparatus, and extends transverse to and immediately below the fabric web, wherein the improvement comprises (a) a flexible strip which has one edge fixed against movement, immediately above the moving fabric web, said fixed edge being substantially ahead of the slot in the direction of travel of the fabric web, the remainder of the strip extending past the slot and resting loosely on the fabric web and on any exposed end portions of the slot, (b) a pair of guide surfaces on which the fabric rests, one extending forward and the other extending rearward from the slot, (c) the guide surfaces together being substantially coextensive with the flexible strip, and forming with the flexible strip a stationary flow channel for the fluid, which flow channel extends forward from the slot for a distance which is from about 7 to 20 times the width of the slot, and also extends rearward from the slot for a distance which is from about 7 to 20 times the width of the slot, whereby the fluid passing through the slot is caused to flow longitudinally through the fabric in such flow channel in two flow paths, one flow path extending forward from the slot for such distance along the flow channel, and the other flow path extending rearward from the slot for such distance along the flow channel.

2. Apparatus as claimed in claim 1 wherein the free end of the flexible strip is in the form of a bead.

3. Apparatus as claimed in claim 1 wherein the flexible strip is made of rubber.

4. Apparatus as claimed in claim 1 wherein the guide surfaces which are in contact with the fabric web are of a low-friction material.

5. Apparatus as claimed in claim 4 wherein the guide surfaces which are in contact with the fabric web are of a plastics material.

6. Apparatus as claimed in claim 1 wherein the slotted tube is adapted to be connected to a source of fluid under pressure, and the apparatus is enclosed in a pressure-tight treatment chamber.

7. Apparatus as claimed in claim 1 wherein the slotted tube, the guide surfaces and the flexible strip are arranged in a container which is adapted to hold a liquid extending to a level at least above the slot in the tube.

8. Apparatus as claimed in claim 1 wherein the pair of guide surfaces are provided on a guide plate having a slot which is coextensive with the slot in the tube.

9. Apparatus as claimed in claim 2 wherein the guide plate comprises two parts, one extending forward and one extending rearward from the tube, a slot being provided between the two parts of the guide plate, and at least one of the parts of the guide plate being adjustable forward and rearward to vary the width of the slot between the two parts.

* * * * *